US007380979B2

(12) United States Patent
Hiranuma et al.

(10) Patent No.: US 7,380,979 B2
(45) Date of Patent: Jun. 3, 2008

(54) BAND FOR TIMEPIECE AND WRISTWATCH

(75) Inventors: Haruki Hiranuma, Chiba (JP); Kinshuroh Itoh, Chiba (JP)

(73) Assignee: Seiko Instruments Inc. (JP)

( * ) Notice: Subject to any disclaimer, the term of this patent is extended or adjusted under 35 U.S.C. 154(b) by 38 days.

(21) Appl. No.: 11/430,586

(22) Filed: May 9, 2006

(65) Prior Publication Data

US 2006/0261106 A1 Nov. 23, 2006

(30) Foreign Application Priority Data

May 10, 2005 (JP) ..... 2005-136924

(51) Int. Cl.
*A44C 5/14* (2006.01)

(52) U.S. Cl. ..... 368/282; 24/265 B; 224/180

(58) Field of Classification Search ..... 224/164, 224/168, 177, 180; 368/282; 24/265 B
See application file for complete search history.

(56) References Cited

U.S. PATENT DOCUMENTS 1,227,598 A * 5/1917 Ellis ..... 24/265 WS
5,483,505 A * 1/1996 Cartier ..... 368/282
6,014,793 A * 1/2000 Howald ..... 24/265 B

FOREIGN PATENT DOCUMENTS

CH 626518 A5 * 11/1981 ..... 224/164
EP 400206 A1 * 12/1990 ..... 368/282

* cited by examiner

*Primary Examiner*—Renee Luebke
(74) *Attorney, Agent, or Firm*—Adams & Wilks

(57) ABSTRACT

A wristwatch has a watch case having two outwardly extending projections between which is inserted an end portion of a watch band. Two pins are disposed in the end portion and slideable outwardly to engage in holes provided in the projections to detachably connect the watch band to the watch case. A cam body is disposed within a cavity in the end portion and has an elliptic cam face so that when the cam body is turned to a first position, the cam face slides the pins outwardly to engage in the holes in the projections and when the cam body is turned 90 degrees to a second position, spring members urge the projections inwardly out of engagement with the holes in the projections. A locking mechanism releasably locks the cam body in the first position and comprises two convex click parts connected to turn with the cam body, and two concave click parts formed in a wall of the cavity at positions to engage with the convex click parts when the cam body is in the first position to thereby lock the two pins in the projection holes.

20 Claims, 7 Drawing Sheets

BAND FOR TIMEPIECE AND WRISTWATCH

BACKGROUND OF THE INVENTION

1. Field of the Invention

The present invention relates to a band for a timepiece and a wristwatch in which the band has been detachably attached to a case band.

2. Description of the Prior Art

Hitherto, there is known a technique in which there has been adapted such that the band is detachably attached to the case band of the wristwatch without using an exclusive tool (for example, refer to Japanese Utility Model No. 3042321 Gazette).

In this technique of the Japanese Utility Model No. 3042321 Gazette, a metal plate having two curl parts is attached to an end part of a leather band, and a spring bar is provided while extending over the two curl parts. The spring bar has a handle having been bent approximately like the V letter in an intermediate part of a spring wire material, and one end and the other end, which have been bent so as to become mutually remote from this handle. Both ends of this spring bar are individually inserted into the two curl parts and rotatably held, and the handle is disposed between the two curl parts. And, in one between the two curl parts, there are provided a slant face causing the handle to slide widely and narrowly, and a taper face holding the handle in a narrow width end of this slant face under a contraction state.

The one end of the spring bar consisting of the spring wire material is always protruded from the curl part which has held the one end. In contrast to this, the other end of the spring bar is protruded from the other curl part by the fact that the handle widens following upon the fact that the handle is brought down to a back face of the band by being rotated, and is immersed into the other curl part by the fact that the handle becomes the contraction state following upon the fact that the handle is raised with respect to the back face of the band by being rotated reversely to the former.

Accordingly, by rotating the handle of the spring bar, the end of this spring bar can be put in and taken out of a hole having been provided in a bow foot of the case band. For this reason, the band can be attached to and detached from the case band without using the exclusive tool.

In a case where a spring property of the spring bar having been formed by bend-working the spring wire material, whose elastic deformation is possible, is strong, there decreases an operability when raising the handle of the spring bar. Reversely to this, in a case where the spring property of the spring bar is weak, there decreases a reliability for attaching and holding the band to the case band with a predetermined strength. The spring property of the spring bar is generally large in its dispersion because the bend working of the handle of the spring bar influences as well. For this reason, in ensuring both of an easy attachment/detachment operability of the band with respect to the case band and a sufficient attachment strength, the technique of the Japanese Utility Model No. 3042321 Gazette is not desirable.

Further, following upon the fact that the spring bar is rotated when attaching and detaching the band, a root of the handle of this spring bar is rubbed by a contact with edges of the two curl parts and liable to be injured, and there is a fear that a corrosion occurs there and that corrosion is not desirable because it is confirmed visually. Additionally, when using the wristwatch, there is considered the fact that the handle of the spring bar existing along the back face of the band contacts with a user's wrist and, in this case, there is the fact that a use feeling is impaired.

Moreover, under a state that the band having been detached from the case band is kept in custody, it is normal that the handle of the spring bar is made a state extending along the back face of the band. For this reason, when attaching the band to the case band of the wristwatch, there becomes necessary a work for immersing the movable end of the spring part into the curl part holding this end, by once raising the handle. Therefore, a work for attaching the band to the case band is comparatively troublesome as well.

An object of the present invention exists in providing a band for timepiece, which can be easily attached to and detached from the case band without using the exclusive tool, can ensure a sufficient attachment strength with respect to the case band, moreover can suppress an injury following upon an attachment/detachment operation and whose use feeling is good, and a wristwatch having possessed this band.

SUMMARY OF THE INVENTION

In order to solve the above problems, a wristwatch of the present invention comprises—in a wristwatch in which a band has been detachably connected to a case band—bow feet which are protruded from the case band by forming a bow crotch receiving an end piece of the band so as to be capable of being put in and taken out, and each of which has an attachment hole, a cam body having a cam part in which an elliptic cam face has been formed and an operation groove, and having been rotatably accommodated in the end piece with the operation groove being exposed, one pair of attachment axles each of which has a cam follower face contacting with the cam face, which are accommodated in the end piece while nipping the cam part so as to be movable in a width direction of the end piece, and each of which is inserted into and withdrawn from the attachment hole by a dimensional difference between a major axis and a minor axis of the cam part, and biasing bodies accommodated in the end piece and respectively pushing the one pair of attachment axles to the cam face.

In the wristwatch of this invention, in order to attach the band to the case band, it suffices if, after disposing the end piece of the band to the bow crotch of the case band, a coin or the like is fitted to the operation groove exposed in an outside of the end piece, and the cam body is rotated by 90 degrees through this coin or the like. By it, a contact position of the cam face of the cam body with respect to the cam follower face changes such that the major axis of the cam body is nipped by the one pair of attachment axles. Following upon this, the one pair of attachment axles are moved in directions mutually separating while resisting against the biasing bodies, and portions, of these attachment axles, in sides opposite to the cam follower faces respectively protrude from width direction both ends of the end piece and are respectively inserted into the attachment holes of the bow feet.

In order to detach the band from the case band, it suffices if, after fitting a coin or the like to the operation groove exposed to an outside of the end piece without using the exclusive tool similarly to a case of the attachment and rotating the cam body by 90 degrees through this coin or the like, the band is detached from the bow crotch. By it, a contact position of the cam face of the cam body with respect to the cam follower face changes such that the minor axis of the cam body is nipped by the one pair of attachment axles. Following upon this, the one pair of attachment axles are moved in directions mutually approaching by biasing forces of the biasing bodies and, since portions of these attachment axles in sides opposite to the cam follower faces are respectively withdrawn from the attachment holes of the bow feet and immersed into insides from width direction both sides of the end piece, it is possible to detach the band from the bow crotch.

Since the band having been detached is under a state that the pair of attachment axles has been retracted into the insides from the width direction at both sides of the end piece, in the case where the band is attached to the case band as already mentioned, it is possible to dispose the end piece in the bow crotch of the case band without first having to retract the pair of attachment axles into the insides from the width direction at both sides of the end piece.

Since the attachment axle bearing the connection of the band to the case band is not formed by a spring wire material, it can be formed by a material, such as metal, and a thickness, which have a strength necessary for the connection to the case band. By this, it is possible to ensure a sufficient attachment strength of the band with respect to the case band. And, since, the one pair of attachment axles, the cam body and the biasing bodies are respectively accommodated in the end piece, there is no fear that they contact with a user's wrist and, even if they contact with the wrist, a use feeling is good because the contact is slight and does not give a foreign body feeling. Further, following upon the attachment/detachment operation of the band, although the attachment axle and the cam body mutually rub, they are difficult to be injured because they contact in faces and, even if injured, there is no fact that the injury is confirmed visually because the cam follower face of the attachment axle and the cam face of the cam body are accommodated in the end piece.

In a preferable mode of a wristwatch of the present invention, there is possessed a locking mechanism holding a state that the major axis of the cam part has been nipped by the one pair of attachment axles.

In the mode of this invention, when—at the same time as the major axis of the cam part of the cam body is nipped by the one pair of attachment axles by a rotation operation of the cam body—these one pair of attachment axles are inserted into the attachment holes of the bow feet and the band is attached to the case band, the locking mechanism functions, and the one pair of attachment axles are held under a state that they have nipped the major axis of the cam body. For this reason, the band can be prevented from being detached by the fact that the cam body is unguardedly rotated at the use time.

Further, in a preferable mode of a wrist watch of the present invention, the locking mechanism is formed by an elastic deformation part having a click convex part and having been provided in the cam body, and a concave click reception part which is provided in an inner face of a cam body accommodation part of the end piece, and with which and from which the click convex part is engaged and disengaged following upon a rotation of the cam body.

In the mode of this invention, following upon the rotation operation of the cam body, when the major axis of the cam body has been nipped by the one pair of attachment axles, since the click convex part of the elastic deformation part engages with the concave click reception part to thereby generate a sound, it is possible to cause the user to feel an attachment completion of the band.

Further, in a preferable mode of a wrist watch of the present invention, the operation groove is caused to be exposed in a back face of the end piece.

In the mode of this invention, since the operation groove, of the cam body, having been exposed in an outside of the end piece is concealed at the use time of the wristwatch, an appearance at the use time is good, and there is no fear that the cam body is unguardedly rotated by the fact that other object contacts with the operation groove at the use time.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

One embodiment of the present invention is explained by referring to FIG. 1-FIG. 7.

Figure 1:
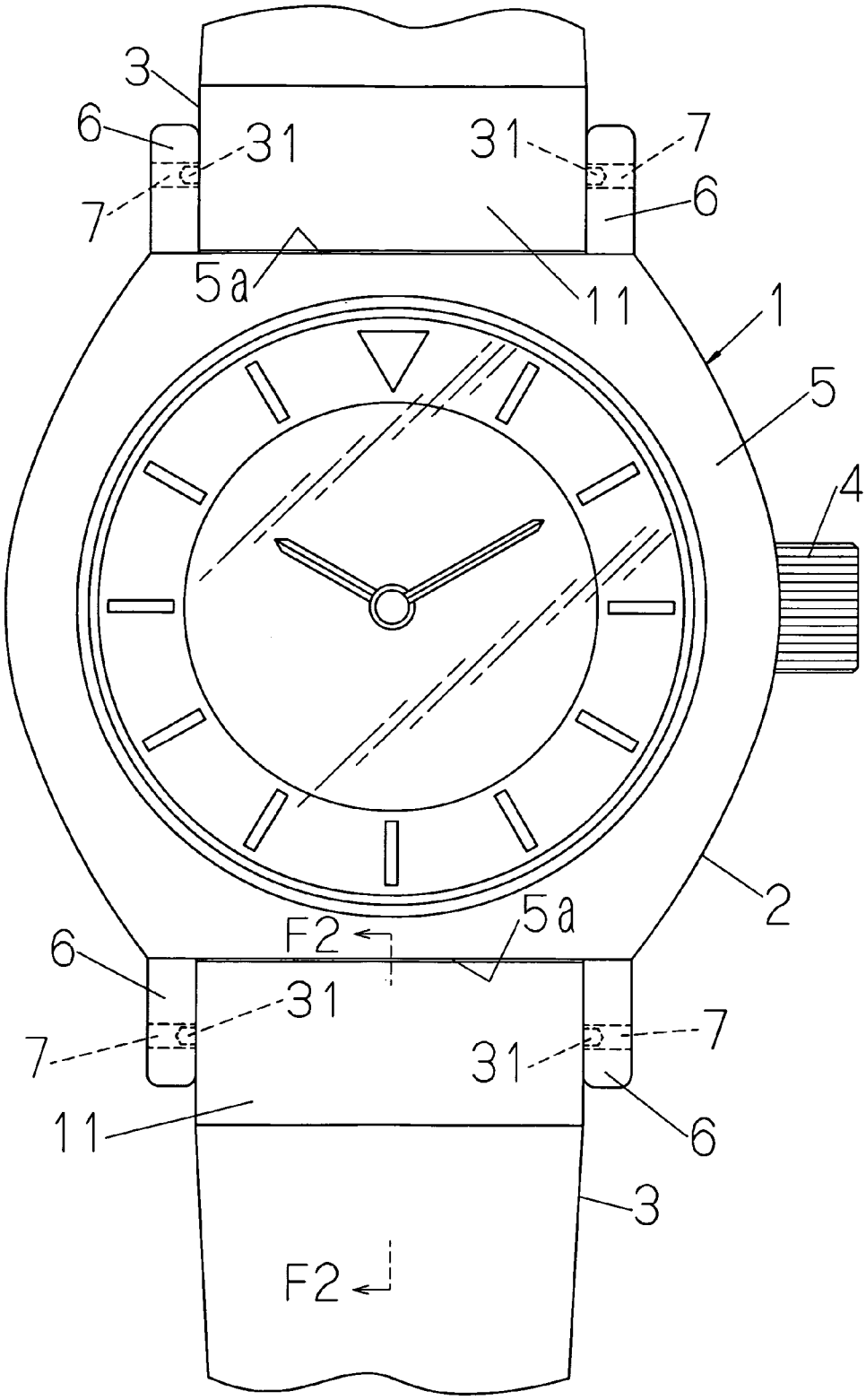
FIG. 1 is a plan view showing a wristwatch according to one exemplary embodiment of the present invention.

In a wristwatch 1 shown in FIG. 1, a watch band 3 is attached to a watch case of a timepiece case assembly 2. Within the timepiece case assembly 2, there are accommodated a dial, a timepiece movement not shown in the drawing, and the like. Incidentally, in FIG. 1, a reference numeral 4 denotes a crown.

Figure 6A:
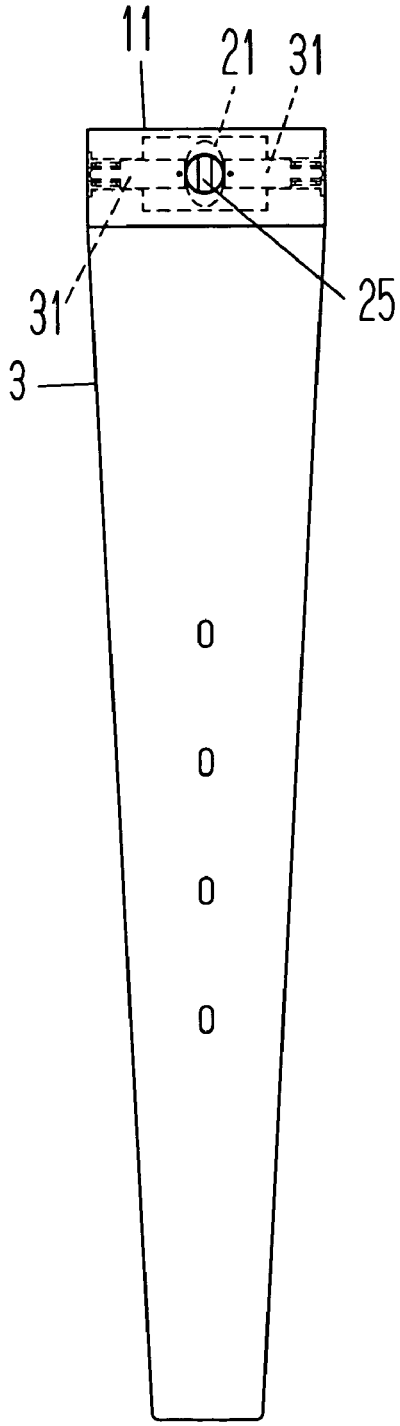
FIG. 6A is a back face view showing a leather-made band usable in one embodiment of the present invention and FIG. 6 B is a back face view showing a metal-made band usable in one embodiment of the present invention.
Figure 6B:
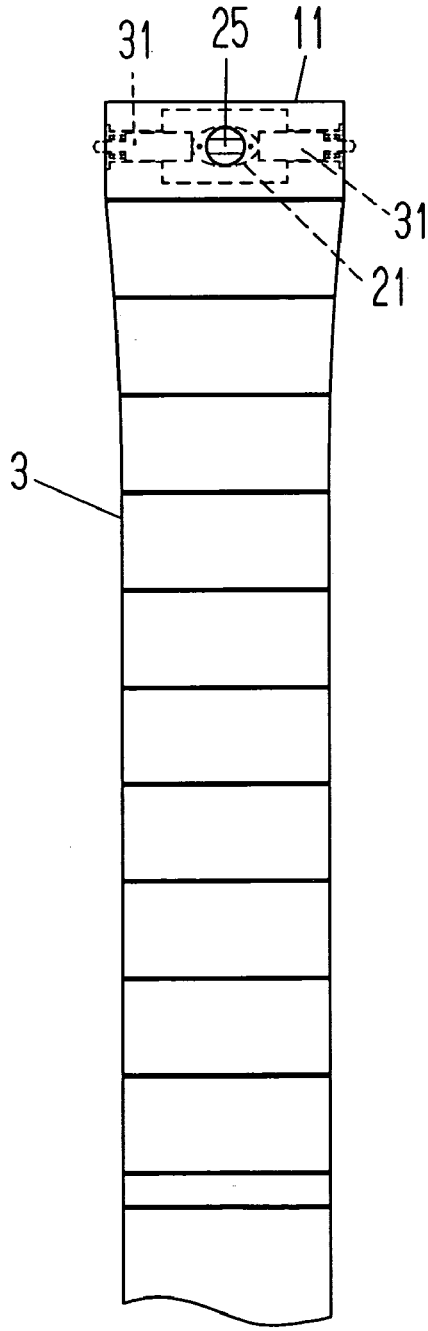

As shown in FIG. 1, the band 3 is detachably attached to a case band 5, made of a metal or a synthetic resin, of the timepiece case assembly 2 at positions corresponding to 6 o'clock and 12 o'clock sides of a dial. As shown in FIG. 6A although the band 3 is one having been formed with its main body being made of synthetic resin, a leather or the like, as shown in FIG. 6B it may be one having been formed by rotatably connecting plural band pieces made of the metal, for instance, by bar-like piece-connecting components with this piece-connecting component being made a center.

Next, there is explained a constitution for attaching and detaching the band 3 to and from the case band 5.

Figure 2:
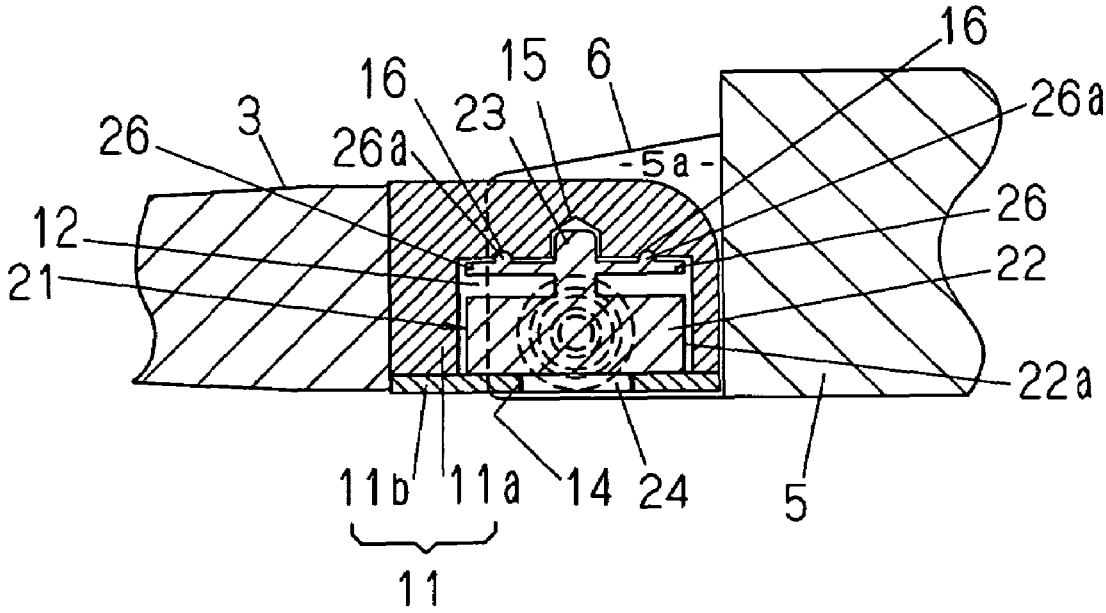
FIG. 2 is a sectional view showing, along an F2-F2 line in FIG. 1, a connection part between a case band and a band.
Figure 3:
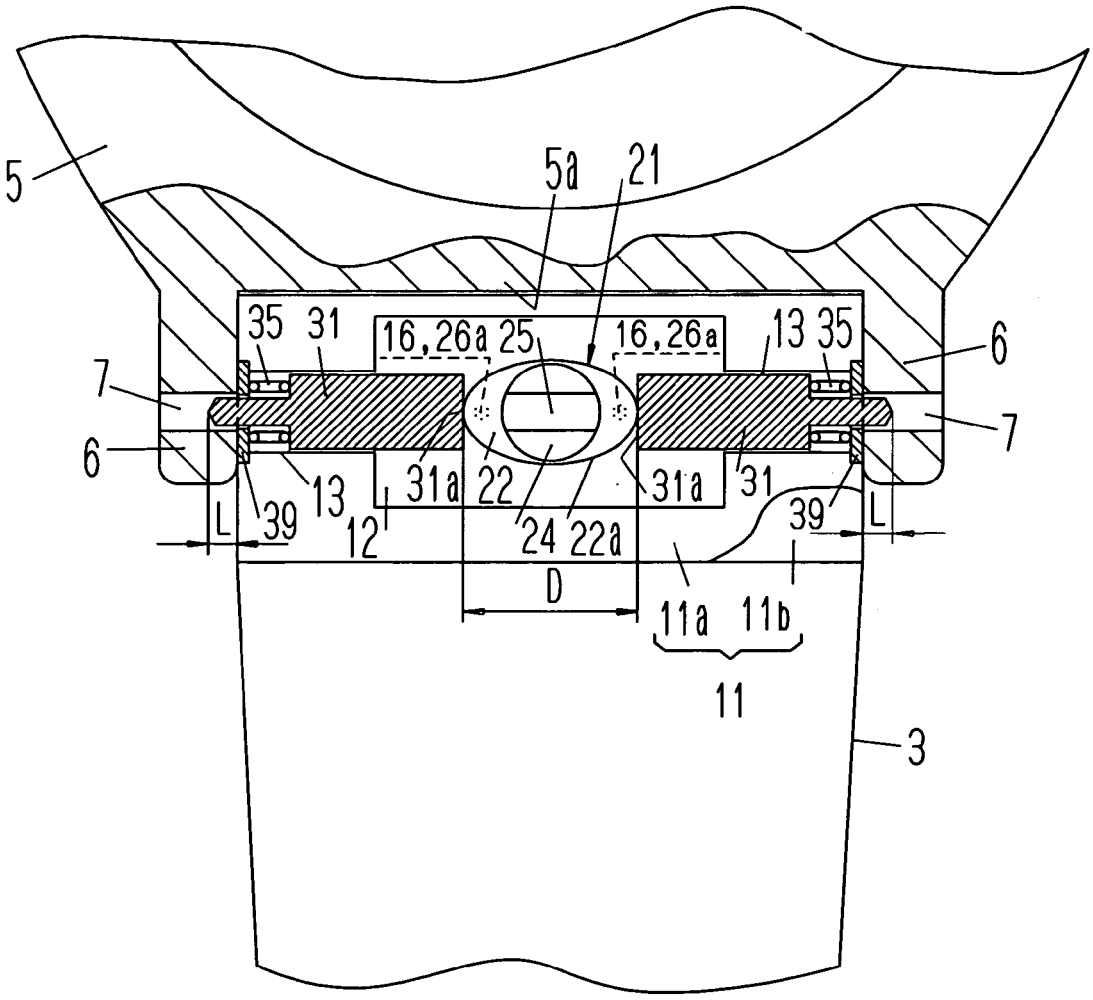
FIG. 3 is a back face view showing the connection part of FIG. 2 under a state having been partially sectioned.
Figure 4:
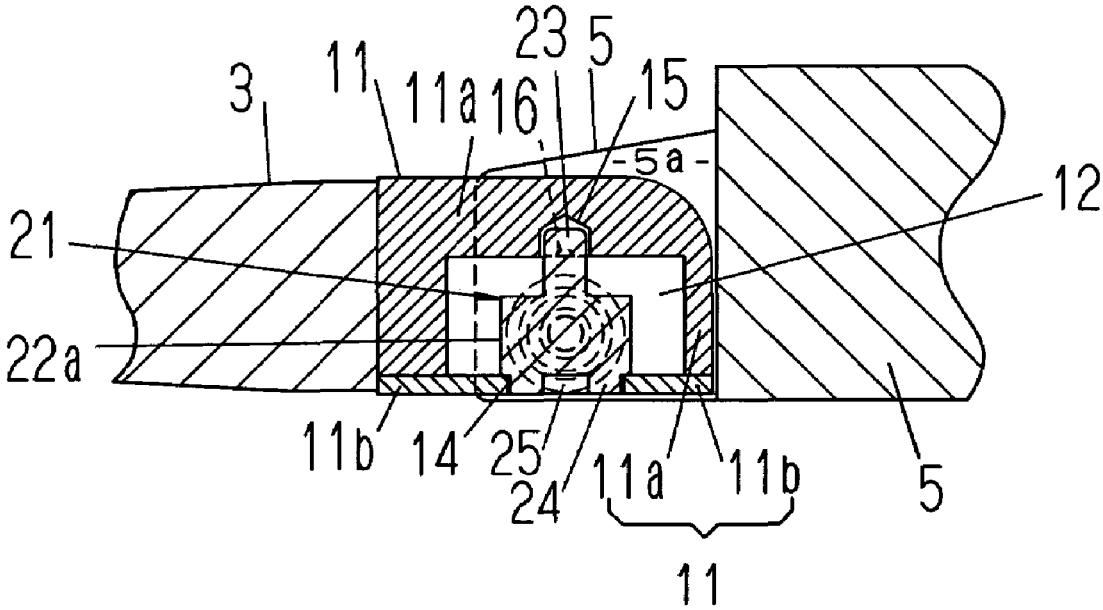
FIG. 4 is a sectional view showing the connection part of FIG. 2 under a state that the band has become detachable.
Figure 7:
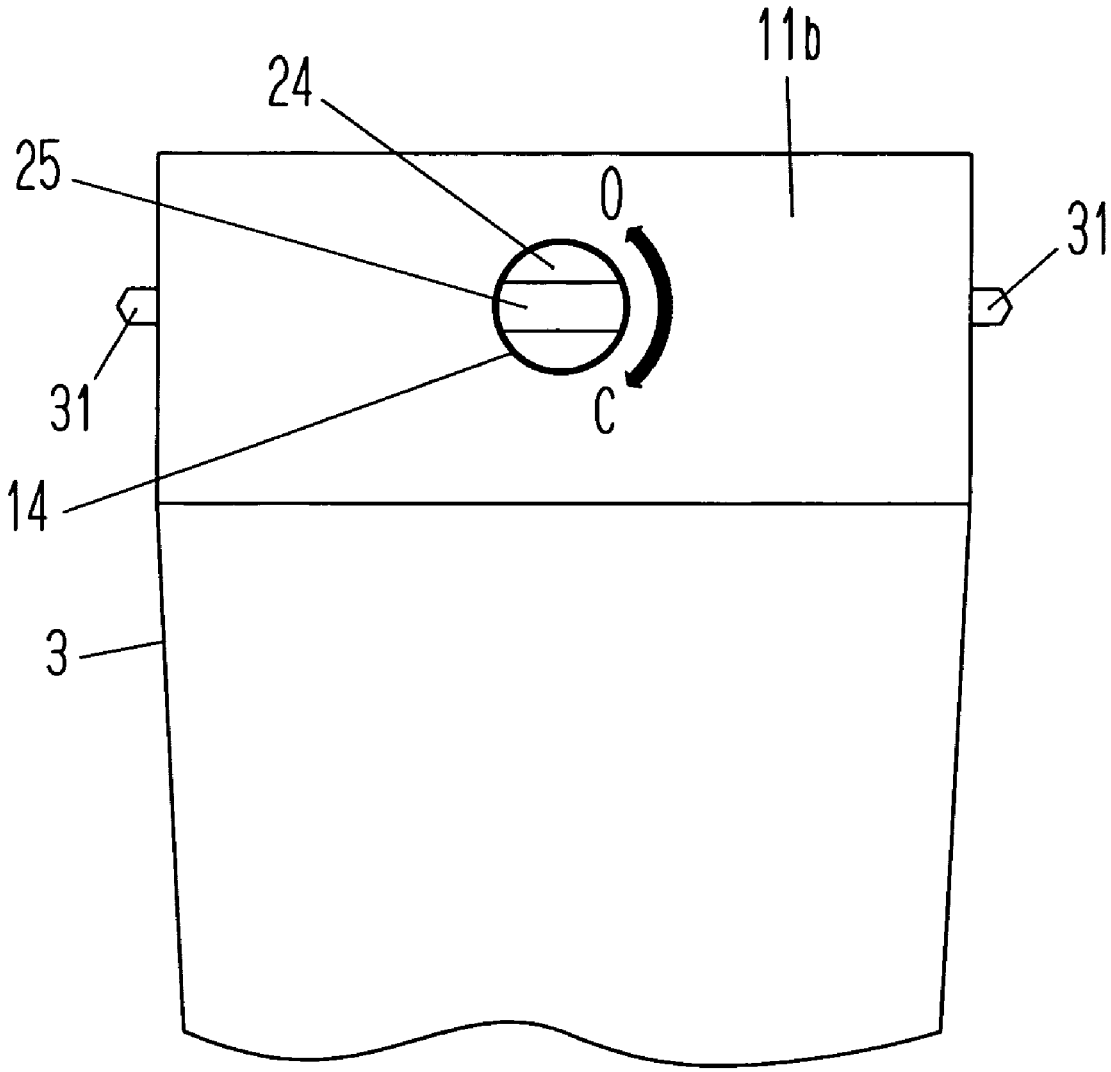
FIG. 7 is a back face view showing, while being enlarged, surroundings of an end piece of the band of FIG. 6A.

In an outer circumference face of the case band 5 of the timepiece case assembly 2, one pair of projections or bow feet (capable of being called bow parts as well) 6 are monolithically, protrusively provided at positions respectively corresponding to the 6 o'clock and 12 o'clock sides of the dial. A bow crotch 5*a* is formed between the two projections or bow feet 6 which are spaced from each other in a 3 o'clock-9 o'clock direction of the dial. As shown in FIG. 1, FIG. 3 and body 11*a* in the width direction. As shown in FIG. 2, FIG. 4 and FIG. 7, a circular hole 14 communicating with a center part of the cam body accommodation part 12 is opened in the cover 11*b*.

The band 3 possesses, in its end part located in a timepiece case assembly 2 side, an end piece 11. Although it is desirable that this end piece 11 is made of the metal, it is also possible to make it from a hard synthetic resin. As shown in FIG. 2 and FIG. 4, the end piece 11 has a piece body 11*a*, and a cover 11*b* mounted to a front face or a back face, desirably the back face, of the piece body 11*a*.

The piece body 11*a* has a cam body accommodation part 12 in the form of a cavity that is covered by the cover 11*b*, and one pair of guide parts 13. The cam body accommodation part 12 has a rectangular crosssectional shape extending in a width direction of the piece body 11*a* as shown in FIG. 3. The guide part 13 is in the form of a groove with its opposite ends being opened respectively to the cam body accommodation part 12 and an end face of the piece denotes a rotation direction in a case where the band 3 is attached to the case band 5.

In a center position of an inner face located in an interior of the cam body accommodation part 12, a bearing concave part 15 is provided, and one pair of click reception parts 16 (refer to FIG. 2 etc.) are provided with this bearing reception concave part 15 being disposed between them. The bearing concave part 15 and the one pair of click reception parts 16 are juxtaposed in the width direction of the piece body 1*a*. The click reception part 16 consists of a concavity having a semispheric shape for instance.

Into the end piece 11, there are incorporated a cam body 21, one pair of slidable pins or attachment axles 31, one pair of biasing members or bodies 35, and one pair of spring shoes 39.

Although it is desirable that the cam body 21 is made of the metal, it is also possible to make it from the hard synthetic resin. The cam body 21 has a cam part 22, a 1st axle part 23 having been monolithically, protrusively provided in one face of this cam part 22 in a thickness direction, and a 2nd axle part 24 having been monolithically, protrusively provided in the other face of the cam part 22 in the thickness direction.

As shown in FIG. 2 and FIG. 4, a circumference face of the cam part 22 forms an elliptic shape cam face 22*a*. Incidentally, here, the elliptic shape is not limited to an ellipse defined in a geometry, and includes also an oval shape, e.g., a shape in which both ends in a direction along which a major axis extends are semicircles depicted by a predetermined radius with its center being made on the major axis and portions between the semicircles are depicted by straight lines mutually parallel to the major axis, or the like. A shape when the 1st axle part 23 and the 2nd axle part 24 have been seen from a thickness direction of the cam body 21 is a circular shape. By fitting the 1st axle part 23 into the bearing concave part 15 and fitting the 2nd axle part 24 to the hole 14, the cam body 21 is rotatably accommodated in the end piece 11 under a state that it has been both-end-supported by the bearing concave part 15 and the hole 14.

As shown in FIG. 7, an end face of the 2nd axle part 24 is exposed in a back face of the end piece 11, and a recessed portion such as an operation groove 25 is formed in the exposed back face. This operation groove 25 is formed so as to be capable of receiving an edge part of an article existing nearby, e.g., coin, from an outside of the end piece 11. Incidentally, signs O and C in FIG. 7 denote indicators provided in the cover 11*b* in order to rotate the cam body 21 by 90 degrees, the indicator O denotes a rotation direction in a case where the band 3 is detached from the case band 5, and the indicator C FIG. 5, an attachment hole 7 is provided in each of the bow feet 6. Each attachment hole 7 is opened to the bow crotch 5*a*.

As shown in FIG. 2, in the 1st axle part 23, there are monolithically formed one pair of elastic deformation parts 26 capable of performing a flexible deformation with the 1st axle part 23 being made a supporting point, and click convex parts 26*a* are provided in faces of the elastic deformation parts 26, facing an interior face of the cam body accommodation part 12. Every time the cam body 21 is turned or rotated by 90 degrees, the click convex part 26*a* engages with and disengages from the clock reception part 16, following flexible deformation of the elastic deformation part 26. As shown in FIG. 3, in a case where the major axis of the cam body 21 lies along a direction extending in the 3 o'clock-9 o'clock direction of the dial, the clock reception part 16 and the elastic deformation part 26 make a locking mechanism holding the major axis under a state that it has been nipped by the one pair of attachment axles 31.

Figure 5:
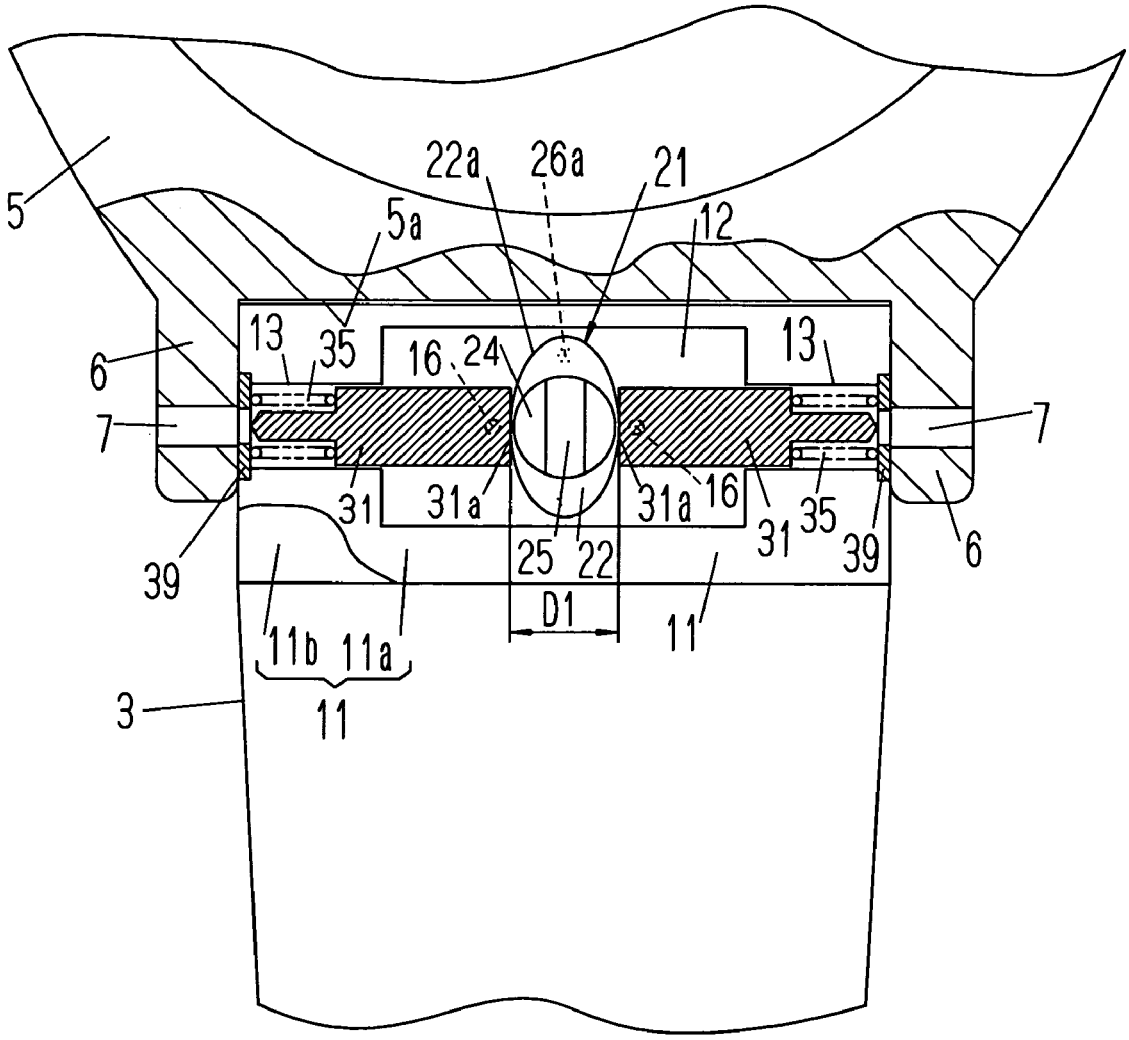
FIG. 5 is a back face view showing the connection part of FIG. 2 while being partially sectioned under the state that the band has become detachable.

Each of the one pair of attachment axles 31 is made of the metal or the hard synthetic resin and, as shown in FIG. 3 and FIG. 5, consists of a large diameter part and a small diameter part having been monolithically, protrusively provided from one end center part of this large diameter part. The small diameter part is a portion inserted into and withdrawn from the attachment hole 7 of the bow foot 6, and has a thickness and a rigidity, which are necessary in order to obtain a predetermined strength for attaching the band 3 to the case band 5. The other end face, of the large diameter part, having been located in a side opposite to the small diameter part is used as a cam follower face 31*a*. The attachment axle 31 is provided in the guide part 13 so as to be movable under a posture that its cam follower face 31*a* has been contacted with the cam face 22*a* of the cam body 21. Accordingly, the one pair of attachment axles 31 are accommodated in the end piece 11 so as to be movable in its width direction while nipping the cam body 21.

Each of the one pair of spring shoes 39 is fixed to the end piece 11 while covering an opening end, of the guide part 13, opening to an end face of the end piece 11 in the width direction, and has a hole in its center part. The small diameter part of the attachment axle 31 can be inserted into and withdrawn from this hole. As the biasing body 35, there is used a spring, e.g., coil spring, and the biasing body 35 consisting of this coil spring is nipped between the spring shoe 39 and the large diameter part of the attachment axle 31 under a compressed state. By these biasing bodies 35, the one pair of attachment axles 31 are always biased in directions mutually approaching, and thereby the cam follower face 31*a* of the attachment axle 31 is push-held to the cam face 21*a* of the cam body 21. For the biasing body 35, it is also possible to use a plate spring instead of the coil spring.

Further, in the above constitution, a relation between a dimensional difference L1 (not shown in the drawing) of a dimension D (refer to FIG. 3) of the major axis of the elliptic cam body 21 from a dimension D1 (refer to FIG. 5) of a minor axis and an insertion depth (catching dimension) L of the small diameter part of the attachment axle 31 with respect to the attachment hole 7 under a state that the band 3 has been attachment-held to the case band 5 as shown in FIG. 3 is set to $L<L1/2$. Additionally, a relation among the dimension D of the major axis of the cam body 21, the dimension D1 of the minor axis of the cam body 21, and the above dimension L is set to $L \leqq (D1-D)/2$.

The cam body 21 of the band 3 having been detached from the case band 5 by procedures mentioned later is held in a direction intersecting perpendicularly to a longitudinal direction (width direction) of the end piece 11, in other words, in a posture that the operation groove 25 extends in a longitudinal direction of the band 3. Under this state, since the one pair of attachment axles 31 nip the minor axis of the cam body 21 in the width direction of the end piece 11, a small diameter tip part of the attachment axle 31 is immersed into the end piece 11, and the elastic deformation part 26 disengages from the click reception part 16 and is held under a flexed state.

In order to connect the band 3 to the case band 5 of the timepiece case assembly 2, first as shown in FIG. 5, the end piece 11 of the band 3 is disposed in the bow crotch 5*a* of the timepiece case assembly 2. In this case, by the fact that a tip face of the end piece 11 butts against an interior face of the bow crotch 5*a*, as to the insertion of the end piece 11 to the bow crotch 5*a*, the hole of the spring shoe 39 and the small diameter tip part of the attachment axle 31 can be positioned to the attachment hole 7. Next, it suffices if, after manually inserting the edge part of a coin or other article into the exposed operation groove 25, the cam body 21 is turned or rotated by the coin or other article in the indicator C direction by 90 degrees.

By the rotation of the cam body 21 at that time, as there changes a contact portion of the cam face 21*a* of the cam body 21 with respect to the cam follower face 31*a* of the attachment axle 31, since the one pair of attachment axles 31 are respectively pushed in directions mutually separating while resisting against the biasing bodies 35 and moved with the guide parts 13 being made guides, each of the small diameter parts of these attachment axles 31 is inserted into the attachment hole 7 of the bow feet 6 while passing through the hole of the spring shoe 39. As shown in FIG. 3, this insertion becomes maximum in a point of time at which the one pair of attachment axles 31 have become so as to nip the major axis of the cam part 22 and, by this, the band 3 is attached to the case band 5.

Since the elastic deformation part 26 is also moved by 90 degrees at the same time as the above operations, in a point of time at which, as shown in FIG. 3, there becomes a state in which the two attachment axles 31 are slid outwardly so that each of the small diameter parts of the attachment axles 31 is inserted to its maximum into the attachment hole 7 and caught thereby, and the click convex part 26*a* of the elastic deformation part 26 is elastically engaged with the click reception part 16. Together with this, there occurs a feel at this time or a butt sound by a metal body contacting another metal body in a case where the end piece 11 and the cam body 21 are metals. For this reason, it is possible to cause the user to feel the attachment completion of the band 34. Moreover, by the engagement between the clock reception part 16 and the clock convex part 26*a*, an unguarded or unwanted rotation of the cam body 21 can be prevented, so that it is possible to hold an attachment state, of the band 3, shown in FIG. 3.

According to the above attachment works of the band 3, by such simple works of inserting the end piece 11 of the band 3 into the bow crotch 5*a* and rotating the cam body 21 by 90 degrees by the coin or the like, it is possible to connect the band 3 to the case band 5 without particularly requiring the exclusive tool.

At the use time of the wristwatch 1, since the operation groove 25 of the cam body 21 is covered by the user's wrist, the operation groove 25 is not confirmed visually and this is desirable in an external appearance, and there is no fear that the cam body 21 is rotated by the fact an article unguardedly impinges against the operation groove 25 from the front side of the wristwatch 1.

In an exchange of the band 3 or the like, in order to detach the band 3 from the case band 5, it suffices if the cam body 21 is rotated by 90 degrees in the indicator O direction by first inserting the edge part of the coin or the like into the operation groove 25 of the cam body 21.

By the rotation of the cam body 21 at that time, as there changes the contact portion of the cam face 21*a* of the cam body 21 with respect to the cam follower face 31 of the attachment axle 31, the one pair of attachment axles 31 are respectively pushed in the directions mutually approaching by the biasing forces of the biasing bodies 35, and moved to cam body 21 sides. As shown in FIG. 5, the movements in this case become maximum in the point of time at which the one pair of attachment axles 31 have become so as to nip the minor axis of the cam part 22. Following upon this, since the small diameter part, of the attachment axle 31, having been inserted into the attachment hole 7 is immersed into the end piece 11 through the hole of the spring shoe 39, under this state (refer to FIG. 5) it is possible to detach the band 3 from the case band 5 by withdrawing the end piece 11 from the bow crotch 5*a*.

Incidentally, following the above detachment operations, the clock convex part 26*a* is separated from the click reception part 16, and the elastic deformation part 26 becomes in a state that it has additionally performed the flexible deformation.

According to the above detachment works of the band 3, after rotating the cam body 21 having been accommodated in the end piece 11 of the band 3 by 90 degrees by the coin or the like, it is possible to detach the band 3 from the case band 5 without particularly requiring the exclusive tool by such a simple work as to withdraw the end piece 11 from the bow crotch 5*a*.

Accordingly, as to the wristwatch 1 of the above-mentioned constitution, its assembly workability is good and, also in the user, it is possible to easily attach and detach the band 3 to and from the case band 5. By this, in a case where the user previously prepares plural bands 3 each of which has possessed the end piece 11 having accommodated the cam body 21 and whose designs are different, it becomes possible to use the wristwatch 1 while giving a change in design to it by easily, suitably exchanging the desired band 3 by the procedures having been already mentioned.

According to the present invention, it is possible to provide a wristwatch in which the band can be attached to and detached from the case band by such a simple work that the cam body is rotated by 90 degrees by using the coin or the like without using the exclusive tool, the sufficient attachment strength with respect to the case band can be ensured by the one pair of attachment axles moved by the cam body, moreover the injury following upon the attachment/detachment operation can be suppressed, and whose use feeling is good as well, and a band for timepiece, which is used in this watch.

What is claimed is:

1. A wristwatch having a band detachably connected to a case band, comprising:

two spaced-apart bow feet which protrude from the case band and which define therebetween a bow crotch for detachably receiving an end piece of the band, each of the bow feet having an attachment hole;

a cam body having a cam part that has an elliptic cam face and an operation groove, the cam body being rotatably accommodated in a cam body accommodation part of the end piece with the operation groove exposed;

two attachment axles each of which has a cam follower face in contact with the cam face, the attachment axles being accommodated in the end piece so as to be movable, in response to rotation of the cam body, in a width direction of the end piece into and out of respective ones of the attachment holes due to a dimensional difference between a major axis and a minor axis of the cam part;

two biasing bodies accommodated in the end piece and respectively pushing the attachment axles into contact with the cam face; and a locking mechanism comprising an elastic deformation cart having a click convex part connected to the cam body for rotation therewith, and a concave clock reception part provided in an inner face of the cam body accommodation part of the end piece, the clock convex part being engageable with and disengageable from the concave clock reception part in response to rotation of the cam body to releasably lock the attachment axles in the attachment holes.

2. A wristwatch according to claim 1; wherein the operation groove is exposed in a back face of the end piece.

3. A wristwatch comprising: a watch case having two spaced-apart projections that project outwardly from the watch case, each projection having an attachment hole; and a watch band having an end portion inserted between the spaced-apart projections, the end portion having two pins each slideable outwardly into respective ones of the attachment holes to attach the watch band to the watch case and each slidable inwardly out of the respective attachment holes to permit detachment of the watch band from the watch case, a turnable cam body having a cam face that is in contact with inner end faces of the two pins and that is configured to slide the two pins outwardly into the attachment holes when the cam body is turned to a first position and to allow the two pins to slide inwardly out of the attachment holes when the cam body is turned to a second position, biasing members that continuously bias the inner end faces of the two pins into contact with the cam face, and a locking mechanism separate from the two pins and comprised of a first click part connected to turn with the cam body and a second click part that has a shape complementary to the shape of the first click part and that is positioned to releasably engage with the first click part when the cam body is in the first position to lock the cam body in the first position and thereby lock the two pins in the respective attachment holes.

4. A wristwatch according to claim 3; wherein the cam body is disposed in a cavity provided within the end portion of the watch band, the first click part is connected to turn with the cam body while making sliding contact with a wall of the cavity, and the second click part is provided on the wall of the cavity along the path of travel of the first click part.

5. A wristwatch according to claim 4; wherein the first click part has a convex shape and the second click part has a concave shape.

6. A wristwatch according to claim 4; wherein the locking mechanism has two first click parts and two second click parts.

7. A wristwatch according to claim 4; wherein the cam face has an elliptic profile.

8. A wristwatch according to claim 4; wherein the cam face has a non-circular profile.

9. A wristwatch according to claim 4; wherein the first click part is connected to the cam body through an elastic part that elastically urges the first click part into contact with the wall of the cavity.

10. A wristwatch according to claim 9; wherein the first click part has a convex shape and the second click part has a concave shape.

11. A wristwatch according to claim 10; wherein the locking mechanism has two first click parts and two second click parts.

12. A wristwatch according to claim 4; wherein the cam body has a recessed portion configured to be engaged by a manually grasped article to effect turning of the cam body.

13. A wristwatch according to claim 12; wherein the recessed portion of the cam body is exposed to the outside through the end portion of the watch band.

14. A wristwatch according to claim 13; wherein the recessed portion of the cam body is exposed at a back face of the end portion.

15. A wristwatch according to claim 3; wherein the first click part has a convex shape and the second click part has a concave shape.

16. A wristwatch according to claim 15; wherein the locking mechanism has two first click parts and two second click parts.

17. A wristwatch according to claim 3; wherein the cam face has an elliptic profile.

18. A wristwatch according to claim 3; wherein the cam body has a recessed portion configured to be engaged by a manually grasped article to effect turning of the cam body.

19. A wristwatch according to claim 18; wherein the recessed portion of the cam body is exposed to the outside through the end portion of the watch band.

20. A wristwatch according to claim 19; wherein the recessed portion of the cam body is exposed at a back face of the end portion.

* * * * *